US006186034B1

(12) United States Patent
Lamons

(10) Patent No.: US 6,186,034 B1
(45) Date of Patent: Feb. 13, 2001

(54) FLEX HANDLE ADJUSTABLE WRENCH

(76) Inventor: Dan E. Lamons, 2500 Roseville Blvd., Chattanooga, TN (US) 37401

( * ) Notice: Under 35 U.S.C. 154(b), the term of this patent shall be extended for 0 days.

(21) Appl. No.: 09/209,349

(22) Filed: Dec. 11, 1998

(51) Int. Cl.[7] ..... B25B 23/16
(52) U.S. Cl. ..... 81/177.9; 81/177.8
(58) Field of Search ..... 81/177.7, 177.8, 81/177.9, DIG. 5

(56) References Cited

U.S. PATENT DOCUMENTS

| | | | | |
|---|---|---|---|---|
| 174,745 | * | 3/1876 | Squire | 81/177.8 |
| 330,594 | * | 11/1885 | Lea | 81/177.8 |
| 943,757 | * | 12/1909 | Stephens | 81/177.9 |
| 1,002,215 | * | 9/1911 | Bovee | 81/177.9 |
| 1,080,121 | | 12/1913 | Oriol . | |
| 1,144,907 | * | 6/1915 | Knipple | 81/177.9 |
| 1,413,798 | * | 4/1922 | Shinn | 81/DIG. 5 |
| 1,528,892 | * | 3/1925 | Pigott et al. | 81/DIG. 5 |
| 1,568,442 | | 1/1926 | Carver . | |
| 1,822,428 | | 9/1931 | Zilliox . | |
| 2,608,894 | | 9/1952 | Miller, Jr. et al. . | |
| 2,680,985 | | 6/1954 | Fish . | |
| 2,722,150 | * | 11/1955 | Green | 81/DIG. 5 |
| 2,886,998 | | 5/1959 | Scott . | |
| 3,270,597 | * | 9/1966 | Neff et al. | 81/177.9 |
| 3,290,970 | | 12/1966 | DeLucia . | |
| 4,084,458 | | 4/1978 | Pasbrig . | |
| 4,581,959 | | 4/1986 | Troiano . | |
| 4,711,145 | * | 12/1987 | Inoue | 81/177.8 |
| 4,794,829 | * | 1/1989 | Mesenhoeller | 81/177.8 |
| 4,901,608 | | 2/1990 | Shieh . | |
| 5,069,091 | | 12/1991 | Bramsiepe et al. . | |
| 5,199,335 | | 4/1993 | Arnold et al. . | |
| 5,515,754 | | 5/1996 | Elkins . | |
| 5,768,960 | | 6/1998 | Archuleta . | |
| 5,870,932 | * | 2/1999 | Brooke | 81/177.9 |
| 6,000,302 | * | 12/1999 | Chiang | 81/177.9 |

FOREIGN PATENT DOCUMENTS

| | | | | |
|---|---|---|---|---|
| 27238 | * | 4/1981 | (EP) | 81/177.9 |
| 377777 | * | 7/1990 | (EP) | 81/177.8 |

* cited by examiner

*Primary Examiner*—David A. Scherbel
*Assistant Examiner*—Joni B. Danganan
(74) *Attorney, Agent, or Firm*—Miller & Martin LLP

(57) ABSTRACT

A tool, such as an adjustable wrench, has an adjustment mechanism to allow the operator to alter the angle of the tool head with respect to at least a portion of the tool handle. The adjustment mechanism, in a preferred embodiment, utilizes a pair of wings, one or both of which may be pushed rearwardly along the handle to disengage the locking mechanism from the tool head to allow for an operator to alter the angle of the tool head with respect to the handle. In a preferred embodiment, the locking mechanism has at least two teeth which engage a toothed hub which faces rearwardly of a pivot point on the tool head and is held into position by a spring when not disengaged by an operator.

19 Claims, 3 Drawing Sheets

FLEX HANDLE ADJUSTABLE WRENCH

BACKGROUND OF THE INVENTION

1. Field of the Invention

The present invention relates generally to devices utilized as tools, and more particularly, to a hand held tool, an adjustable wrench having an adjustable angle handle.

2. Description of Related Art

Many tools have been developed over time with specialized features adapted for particular conditions. One condition is the ability to use a single wrench on a variety of different sized hardware, especially nuts, bolts, screws or the like having different head sizes.

Adjustable wrenches, commonly known as crescent wrenches, are known in the art. In a common configuration, these tools have a handle connected to a fixed jaw and a movable jaw adjustable relative to the fixed jaw by a thumbscrew. The movement of the thumbscrew causes the movable jaw to move either closer to or farther away from the fixed jaw.

A second working condition which has given rise to a specialized tool feature is a crowded, or enclosed, environment. In this situation, the turning arc of the tool, such as a wrench, may be blocked or limited by neighboring objects or structures. Numerous designs of hand tools have been created to allow a user to alter the angle of the tool head relative to at least a portion of the tool handle. These tools are often described as having a flex-head or flex-handle. A variety of flex-handle tools have been developed which overcome the problem of obstructions in a plane parallel to the head of a tool. By allowing an operator to adjust the angular position of the handle orthogonally with respect to the plane of the tool head, an operator can maneuver the tool's handle to avoid an obstruction.

One type of prior art utilizes a single spring contact from within a bore in a handle to interface a recess in a portion of the tool head (U.S. Pat. Nos. 4,581,959, 2,608,894, 2,886, 998, 1,568,442). An advancement of this design is described and illustrated in U.S. Pat. Nos. 1,080,121 and 1,568,442 which allows an operator to manually disengage the spring contact.

A second type of prior art device involves the use of a pivoting device such that the tool head may be freely pivoted relative to a handle (U.S. Pat. No. 4,084,456).

Even with these improvements, a need exists for an improved flex handle tool. Furthermore, a need exists for an improved pivoting head adjustable wrench.

A need exists for a flex handle tool which utilizes a pair of easily graspable wings to easily allow a user to alter an angle between the head of the tool and the tool handle.

A need exists for a simple, yet effective engagement mechanism to fix the angle of a tool head relative to a portion of the tool handle.

Furthermore, a need exists for an adjustable angle tool with an angle adjustment mechanism having significant holding strength once the desired angle is selected.

Further still, a need exists for an adjustable angle tool having an angle adjustment mechanism wherein the portion of the angle adjustment mechanism attached to the tool head is contained within planes containing the surfaces of the tool at working portions of the tool head.

SUMMARY OF THE INVENTION

The present invention recognizes and addresses the foregoing advantages, and others, of prior art construction and methods.

Accordingly, it is an object of the present invention to provide an improved adjustable angle tool that is suitable for use in a crowded environment. The preferred embodiment of this invention utilizes an adjustable wrench, commonly known as a crescent wrench, as a part of the tool head.

A first advantage of a presently preferred embodiment is the use of a pair of wings to easily allow a user to alter an angle between the head of the tool and the tool handle. These wings, or ears, can be operated either by a single finger on a single wing or by multiple fingers on the pair, or plurality, of wings.

A second advantage of a presently preferred embodiment is the incorporation of an effective engagement mechanism to fix the angle of a tool head relative to a portion of the tool handle. A minimum of two teeth of the tool head engagement portion engage a locking mechanism.

Another advantage of the presently preferred embodiment is the tool head engagement portion fits within an angle created by opposing outer surfacess of the working portion of the tool head.

Yet another advantage of the presently preferred embodiment is a linear disengagement feature of the locking mechanism to allow for a quick and effective angle adjustment capability.

Additional objects and advantages of the invention will be set forth in part in the following description, or may be obvious from the description or accompanying drawings, or may be learned through practice of the invention.

The accompanying drawings, which are incorporated in and constitute a part of the specification, illustrate several embodiments of the invention and together with the description serve to explain the principles of the invention.

Figure 1:
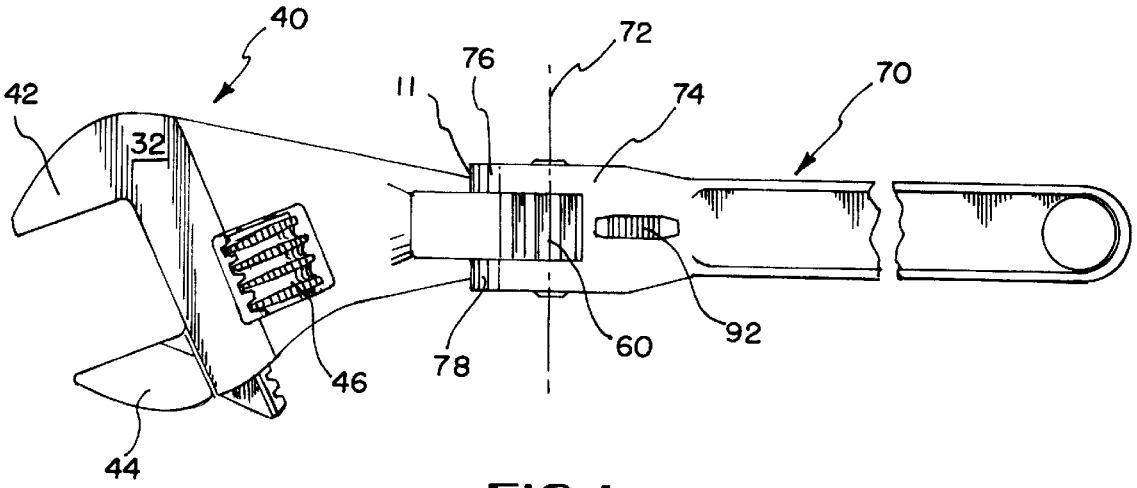
FIG. 1 is a side plan view of a preferred embodiment.

Repeat use of reference numerals in the present specification represent like, similar or analogous parts, features or elements of the present invention throughout several views.

DETAILED DESCRIPTION OF THE PREFERRED EMBODIMENTS

Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield still a further embodiment. Thus, it is intended that the present invention covers such modifications and variations as come within the scope of the appended claims and their equivalents.

The present invention is concerned with an improved tool, specifically a flex handle tool with an adjustable wrench as a part of the tool head.

Accordingly, FIG. 1 is a side view of a flex handle adjustable wrench 10. A tool head 40 is joined to a handle portion 70. In the preferred embodiment, a pin 80 (shown in phantom in FIG. 2) is utilized to connect the handle portion 70 to the tool head 40. Also in the preferred embodiment, the tool head 40 contains an adjustable wrench device. The handle portion 70 may be etched or formed with English and/or metric scales to create a multipurpose tool. A vernier type scale, a ruler type scale or other scale type may be incorporated into the multipurpose tool, preferably upon the upon the jaws of the adjustable wrench to provide a caliper type measuring device.

Figure 2:
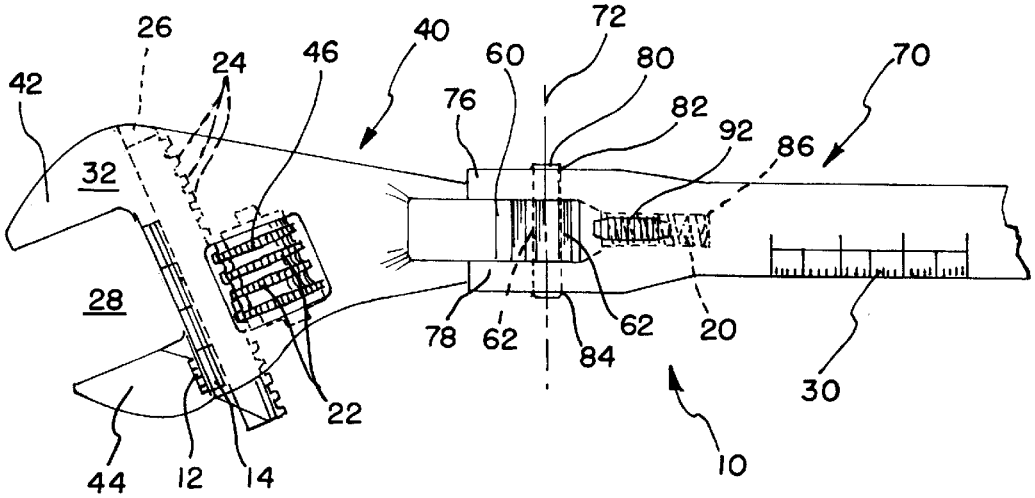
FIG. 2 is plan view of the preferred embodiment of the present invention with interior parts shown in phantom as seen from the side.

The adjustable wrench, commonly known as a crescent wrench has a fixed jaw 42, a movable jaw 44 and a thumbscrew 46. Twisting the thumbscrew 46 causes the movable jaw 44 to move either closer, or father away from, the fixed jaw 42 depending upon the direction the thumbscrew 46 is rotated. Crescent wrench adjustment mechanisms such as this are known in the art. FIG. 2 will assist in illustrating the interior workings of a common style of crescent wrench which are illustrated in phantom. As the thumbscrew 46 is twisted, the movable jaw 44 is contacted by the screw threads 22 of the thumbscrew 46 in ridge portions 24 of the movable jaw 44. As the screw threads 22 move relative to a fixed portion of the tool head 40 with rotational movement, the movable jaw 44 is linearly displaced along an adjustment channel 26 from either the top to the bottom or from the bottom to the top of the tool head 40. The linear movement of the movable jaw 44 causes the size of the jaw opening 28 in the adjustable wrench device to increase or decrease. Of course, there are numerous other designs for adjustable wrench heads and this invention is not limited to the particular crescent wrench adjustment mechanism illustrated in the drawings. The various tool head designs intended to be used with the invention are operated by rotation in a plane.

An alternatively preferred adjustable wrench device may be utilized as well. The design illustrated in FIG. 6 has a second recessed portion 43 and a third recessed portion 45 located respectively on the fixed jaw 42 and on the movable jaw 44 of the adjustable wrench device. These recessed portions 43,45 may require less material to be utilized during construction and provide areas for additional commercial, safety and use data that will remain protected in these portions which are subjected to extreme use. Recess depths of 0.75 mm to 2 mm (0.02953 in to 0.07974 in) have been found adequate to maintain structural soundness while offering protection to writings in the second and third recessed portions 43,45.

A scale, such as a vernier scale illustrated in FIG. 2, may also be incorporated into the tool head 40 utilizing an adjustable wrench device. A vernier scale may employ mechanisms such as a graduated scale 12 on the movable jaw 44 and a fixed graduated scale 14 on a fixed portion of the tool head 40 such as the first planar outer surface portion 32. The vernier scale will allow a user to measure a fractional part of one of the divisions on the fixed graduated scale 14.

Figure 6:
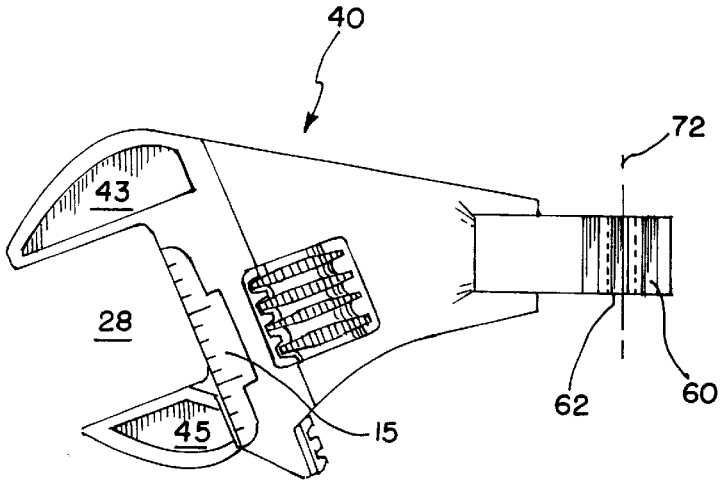
FIG. 6 is a side plan view of an alternatively preferred embodiment of an adjustable wrench device.

In the alternatively preferred embodiment illustrated in FIG. 6, a first recessed portion 15 is located on a forward edge of a fixed portion of the tool head 40. The first recessed portion 15 may incorporate the fixed graduated scale 14 or may be receptive to marking by a user with an element like a grease pencil so that a user could quickly change between a variety of differing jaw openings 28. The first recessed portion 15 may be characterized as cooperating with the movable jaw portion 44 so as to measure distance.

Figure 5:
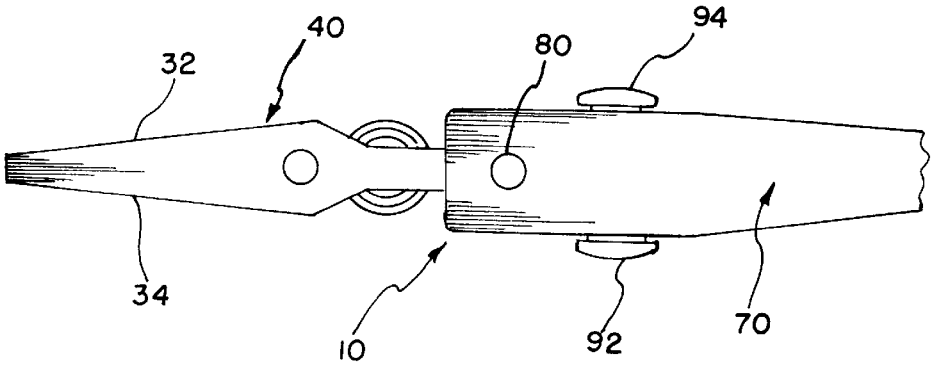
FIG. 5 is a top elevational view of the preferred embodiment.

The first recessed portion 15 allows inexpensive engraving to be performed on the first recessed portion 15 which will be below the surface of the tool 10. This prevents wear and tear on the tool 10, such as from repeated sliding into position, from obscuring any markings on the first recessed portion 15. A depth of one half to one millimeter (0.019685 in to 0.03937 in) has been found satisfactory to limit wear and tear on markings in the first recessed portion 15 without compromising structural soundness. The markings in the recessed portions 15,43,45 may be performed by laser process engraving or other marking methods. A similarly recessed portion, the fourth recessed portion 47, illustrated in FIG. 5, may be engraved on the tool head 40 on a top or bottom surface. The fourth recessed portion 47 may be engraved with customary warnings, other information or logos.

The handle portion 70 may also incorporate a distance measuring device. A ruler 30 is illustrated in FIG. 2. Other distance measurement devices may include either/or both metric and English rulers. This distance measuring device may be incorporated into a recessed portion of the handle in a similar fashion as data and the scale may be incorporated into the tool head 40.

Figure 3:
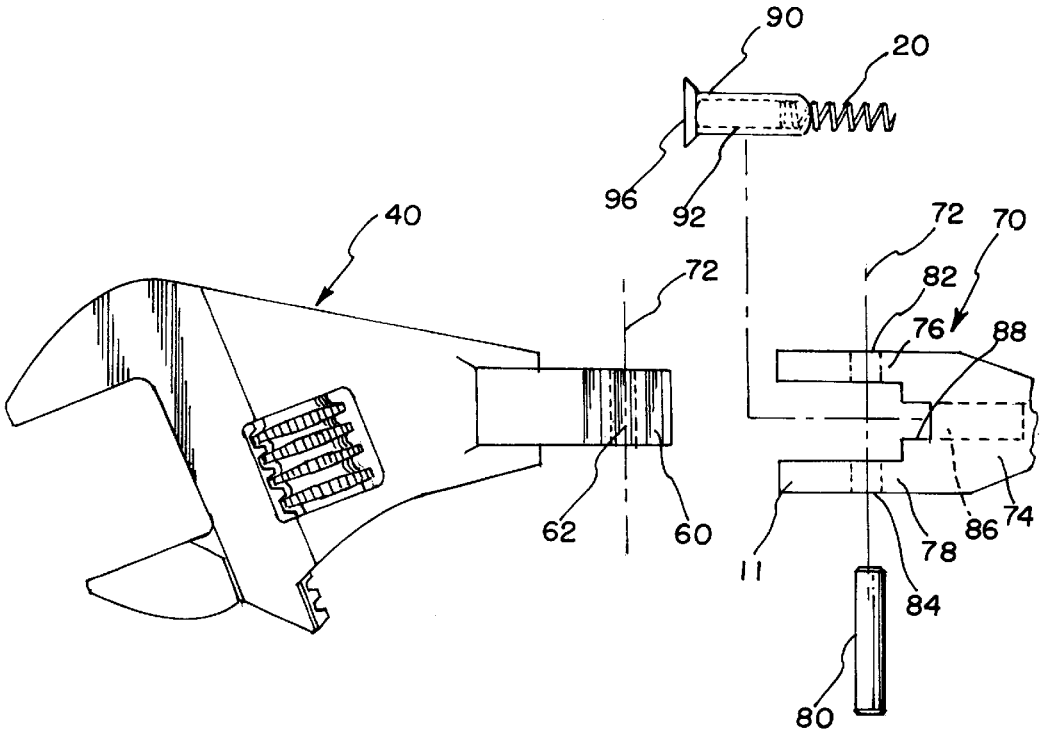
FIG. 3 is an exploded view of the preferred embodiment of the present invention with interior channels shown in phantom.

The tool 10 illustrated in FIG. 3 is an exploded view of a presently preferred embodiment. The term hand tool is commonly utilized to illustrate that this type of tool 10 may be used by an individual.

FIG. 3 shows the tool 10 has a yoke at a forward end 11 of the tool 10. This yoke, in the form of a clevis 74, in a presently preferred embodiment, has a pair of clevis arms 76,78 which are located to the top and bottom of at least a portion of a toothed hub 60 extending rearwardly from the tool head 40. The clevis arms 76,78 are illustrated symmetrical about a center axis of the handle portion 70, but they need not be symmetrical, nor centered about a central axis of the handle portion 70. As illustrated in FIG. 3, the clevis arms 76,78 have arm apertures 82,84 (shown in phantom) located at the pivot 72 to receive a pin 80. The axis of the pivot 72 is parallel to the operating plane of the tool head 40, so that the handle portion 70 may be pivoted perpendicular to the operating plane.

Numerous other methods known in the art are available for achieving a pivot 72 including the use of bearings, sleeves, and hinges, which fall within the spirit of the present invention.

At least a portion of the toothed hub 60 faces rearwardly of the pivot 72. As illustrated in phantom in FIGS. 2 and 3, the pivot 72 receives a pin 80 in arm apertures 82,84 and in hub aperture 62 as a mechanism which allows for pivoting of the tool head 40 with respect to the handle portion 70. Also, at least a portion of the toothed hub 60 extends into said clevis 74 rearwardly of the pivot 72. The toothed hub 60 should have a plurality of recessed surfaces, preferably hub teeth are utilized.

The toothed hub 60 should have a plurality of hub teeth spanning an arc of greater than one hundred eighty degrees, though the arc spanned by the hub teeth could be anything from about twenty degrees to over two hundred and seventy degrees. Only three of the hub teeth 95,97,99 are individually numbered in FIGS. 4A and 4B, as a matter of convenience, but it should be obvious that at least three hub teeth 95,97,99 must be utilized and preferably ten or more.

The greater the arc spanned by hub teeth the larger the angle that may be obtained between the tool head 40 and the handle portion 70. In the illustrated embodiment, the hub teeth span an arc of approximately two hundred-twenty degrees. This allows for the tool handle portion 70 to obtain an angle of ninety degrees to either side of the tool head 40. Also it is preferred that the arc spanned by the hub teeth is substantially symmetrical about a central axis of the tool head 40.

Figure 4A:
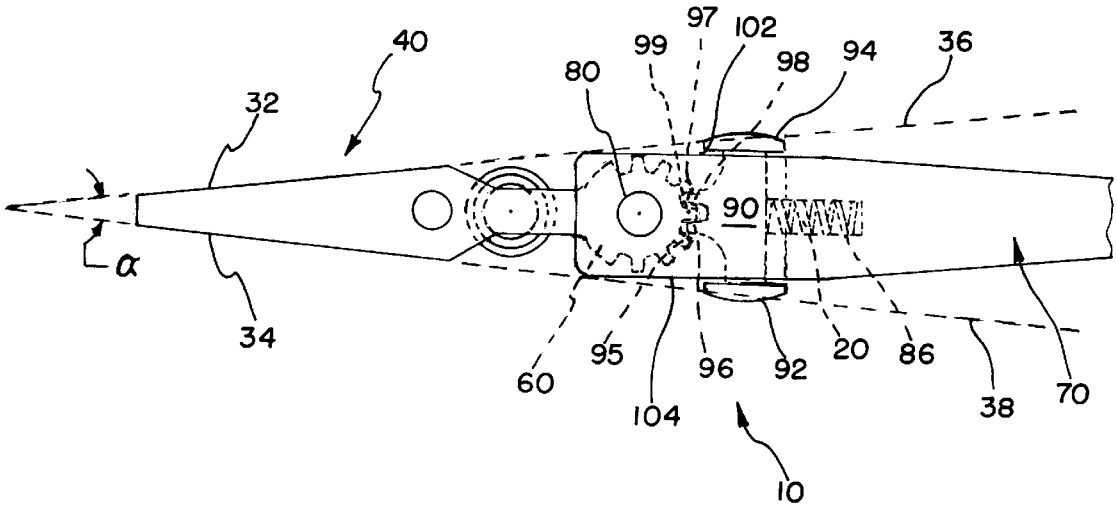
FIG. 4A is a top plan view of the preferred embodiment of the present invention in a first position with interior parts shown in phantom.

A single wing 92 of the locking mechanism 90 is illustrated in the side view of FIG. 1. FIG. 4A shows an installed locking mechanism 90 from a top view. The locking mechanism 90 has at least two teeth 96,98 and two wings 92,94. More than two teeth 96,98 may be utilized. Alternatively, embodiments could include three teeth or four teeth. The preferred embodiment also utilizes at least two wings 92,94. The wings 92,94 shown are located on side surfaces of the clevis 74. However, the wings 92,94 could be located on other surfaces of the clevis 74 or on the handle portion 70.

The locking mechanism 90 is carried at least partially within the clevis 74 opposite the toothed hub 60. The at least two teeth 96,98 engage at least two surfaces of the toothed hub 60 when the locking mechanism 90 is in a first position. The at least two teeth 96,98, in a preferred embodiment, fit between and around at least three teeth 95,97,99 of the toothed hub 60. The at least two teeth 96,98 are around hub tooth 99 and between hub teeth 95,97. At least two surfaces of hub teeth 95,97,99 will be in contact with the at least two teeth 96,98 of the locking mechanism 90. It should be apparent to one skilled in the art that if three teeth 96,98 are present on the locking mechanism 90, then they will fit between and around four teeth of the toothed hub 60. This same logical process would continue if more than three teeth 96,98 are utilized.

In a preferred embodiment, the plurality of teeth 96,98 are configured to cooperate concentrically with the toothed hub 60. More specifically, the arc of curvature of the locking mechanism's teeth 96,98 coincides with the arc of curvature of the toothed hub 60. It is presently believed that a greater amount of surface area of the hub teeth 95,97,99 in contact with the locking mechanism's at least two teeth 96,98 results in greater strength of the tool 10 with respect to inadvertently transitioning from the first position to a second position. Additionally, it is presently believed that the tool 10 will exert greater resistance to breaking, wearing, or harming hub teeth 95,97,99 or any of the at least two teeth 96,98 of the locking mechanism 90.

Figure 4B:
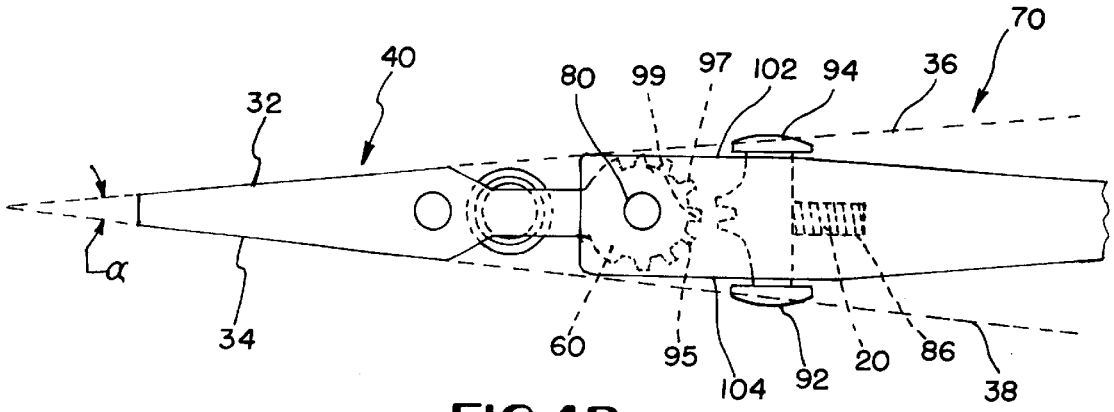
FIG. 4B is a top plan view of the preferred embodiment of the present invention in a second position with interior parts shown in phantom.

As shown in FIGS. 4A and 4B, the wings 92,94 extend a distance beyond outer surfaces 102,104 of the clevis 74. The wings 92,94 are shown almost flush with the outer surfaces 102,104 of the clevis 74 and are substantially perpendicular to a plane of motion of the adjustable wrench device. Preferably there should only be about 0.003 inches clearance between the wings 92,94 and the outer surfaces 102,104. The wings 92,94 may also have a knurled outer surface portion for easy grasping. The wings 92,94 function as a pair and are located respectively on opposing sides of the clevis 74.

Either a single wing 92 or 94 or both wings 92,94 may be moved by an operator, such as a user of the tool 10, in order to place the tool 10 in a second position. Changing the status of the tool 10 from the first position to a second position will then allow the operator to change the angle of the tool head 40 with respect to the handle portion 70. In the illustrated embodiment, the locking mechanism 90 is biased toward but may be linearly displaced in a direction away from the toothed hub 60. The linear displacement may be in a direction radially away from a center of the toothed hub 60. The linear displacement feature may allow for rapid repositioning of the angle of the tool 10. As illustrated in FIG. 4B, the linear displacement of the locking mechanism 90 affects the position of the wings 92,94. The wings 92,94 are located a first distance from a forward end 11 of the handle portion 70 in a first position. When the wings 92,94 are moved to a second position, the wings 92,94 are a second distance from the forward end 11 of the handle portion 70. The second distance is greater than the first distance. The wings 92,94 are preferably located so that they are aligned in a plane perpendicular to the axis of the pivot 72.

A spring device is utilized to bias the locking mechanism 90 against the toothed hub 60 in the first position. The illustrated embodiment of the spring device utilizes a metal coil spring 20 which is partially compressed when the locking mechanism 90 is in the first position. The spring device need not include a metal coil spring 20, but could utilize any compressible and resilient material. In the illustrated embodiment the coil spring 20 is attached to the locking mechanism 90, however, it is within the scope of this invention that the spring device merely cooperate with the locking mechanism 90. Any of a number of structures may intervene between the at least two teeth 92,94 of the locking mechanism 90 and the spring device including, but not limited to, washers, extension members, etc.

While one end of the coil spring 20 is located in proximity with the locking mechanism 90, another portion of the coil spring 20 is shown received within a bore 86 in the handle portion 70. The bore 86 need not be round, but may be constructed by drilling out a portion or casting a bore 86 in the handle portion 70. The bore 86 may have planar or curved side surfaces.

In order to maneuver the locking mechanism 90 from the first position to a second position, the operator's force on one or both wings 92,94 will cause the coil spring 20 to undergo compression. The state of compression of the coil spring 20 in the second position will be greater than the state of compression of the coil spring 20 in the first position. When the coil spring 20 is transitioned from the first position to a second position, the at least two teeth 96,98 of the locking mechanism 90 will be disengaged from the toothed hub 60 of the tool head 40.

Once the at least two teeth 92,94 of the locking mechanism 90 are disengaged from the toothed hub 60, the tool head 40 will be rotatable about the pivot 72 so that an operator may change the angle of the tool head 40 with respect to the handle portion 70. The locking mechanism 90 will be maintained in the second position while the operator selects a desired angle for tool 10 operation. When the locking mechanism 90 is positioned to the second position, the locking mechanism 90 moves at least partially into a disengagement slot 88 in the handle portion 70 or clevis 74 of the handle portion 70. The disengagement slot 88 receives at least a portion of the locking mechanism 90 when the locking mechanism 90 is in the second position in the presently preferred embodiment.

Once the operator chooses a desired angle between the tool head 40 and the handle portion 70, the operator may release the compressive force exerted on the coil spring 20 allowing the locking mechanism 90 to re-engage the toothed hub 60 so that the at least two teeth 92,94 of the locking mechanism 90 engage surfaces of the toothed hub 60 as described above. Once again, the spring device exerts a force on the locking mechanism 90 in the first position.

The spring device should exert a significant enough force on the locking mechanism 90 when in the first position such that the locking mechanism 90 will not be transitioned to a second position without the operator exerting a force on either, or both, of the wings 92,94. This will require the spring device to be in a state of compression in the first position. Also, the operator must exert a further compressive force on the spring device to transition the locking mechanism 90 from the first position to a second position.

The preferred embodiment utilizes an adjustable wrench as a part of the tool head 40 as described above. The adjustable wrench has a first and a second planar outer surface portion 32,34. First and second planes 36,38 include first and second planar outer surface portions 32,34. Where the first and second planes 36,38 intersect is illustrated in FIGS. 4A and 4B as plane intersection angle $\alpha$. The toothed hub 60 shown is located between the first and second planes 36,38 and within the plane intersection angle $\alpha$. This permits the wrench to be used without interference from the flex handle adjusting mechanism.

In a preferred embodiment, the distance from the pivot 72 to the forward end of the fixed jaw 42 is about twenty five to thirty five percent of the overall length of the tool 10. In an eight inch (20.32 cm) version of the tool 10, a distance of two and one quarter inches from the pivot 72 to the forward end of the fixed jaw 42 has been found to function satisfactory. It is possible that a range of twenty to forty percent may be satisfactory as well.

It will be understood that alternative designs and slight modifications of the invention are possible and will suggest themselves to those skilled in the art. All such modifications that are contained within the spirit of the specification are intended to come within the scope of this application.

What is claimed is:

1. A tool comprising:

a handle portion having a yoke at a forward end;

a tool head coupled to said yoke at a pivot, said tool head having first and second planar outer surface portions and a toothed hub with a plurality of recessed surfaces and at least a portion of said toothed hub faces rearwardly of said pivot into said yoke, said first and second planar outer surface portions coinciding with a first and a second plane, said first and second planes intersecting at a plane intersection angle, and said toothed hub located between the first and second planes and within the plane intersection angle;

a locking mechanism having at least two teeth, said locking mechanism carried at least partially within said yoke opposite the toothed hub, and whereby said locking mechanism may be positioned to a first position in which said at least two teeth engage at least two recessed surfaces of the toothed hub and a second position in which said locking mechanism is linearly displaced in a direction away from said toothed hub to allow rotation of said tool head about the pivot.

2. The tool of claim 1 wherein said tool head further comprises an adjustable wrench device.

3. The tool of claim 2 wherein said adjustable wrench device further comprises a scale and said handle portion further comprises a distance measuring device.

4. The tool of claim 3 wherein said adjustable wrench device further comprises a first recessed portion, said first recessed portion cooperating with a movable jaw portion of said adjustable wrench device to measure distance.

5. The tool of claim 2 wherein said adjustable wrench device further comprises second and third recessed portions located respectively on a fixed jaw and on a movable jaw of the adjustable wrench device.

6. The tool of claim 2 wherein said adjustable wrench device further comprises an engraved recessed portion.

7. The tool of claim 1 wherein said locking mechanism further comprises at least two wings, at least a portion of which have knurled outer surfaces.

8. The tool of claim 1 wherein said toothed hub has a plurality of hub teeth spanning an arc of greater than one hundred eighty degrees.

9. The tool of claim 8 wherein said plurality of hub teeth span an arc of between about two hundred degrees and about two hundred-fifty degrees.

10. A flex handle tool comprising:

a handle portion having a yoke at a forward end;

a tool head for rotational operation in a plane coupled to said yoke at a pivot for movement of the handle portion orthogonal to the operational plane, said tool head having an adjustable wrench device with first and second planar outer surface portions and a toothed hub with a plurality of recessed surfaces facing rearwardly of said pivot into said yoke, said first and second planar outer surface portions coinciding with a first and a second plane, said first and second planes intersecting at a plane intersection angle, and said toothed hub located between the first and second planes and within the plane intersection angle;

a locking mechanism having at least two wings, said locking mechanism carried at least partially within said yoke opposite the toothed hub, said wings located respectively on opposing sides of said locking mechanism, and whereby said locking mechanism may be positioned to a first position in which said at least two wings are located a first distance from the forward end of the handle and to a second position in which said at least two wings are a second distance from said forward end, said second distance being greater than said first distance to allow pivoting of said tool head.

11. The flex handle tool of claim 10 wherein said tool head further comprises an adjustable wrench device.

12. The flex handle tool of claim 11 wherein a distance from the pivot to a forward end of a fixed jaw of the adjustable wrench device is about 25–35% of an overall length of the flex handle tool.

13. The flex handle tool of claim 10 wherein a distance from the pivot to a forward end of a fixed jaw of the adjustable wrench device is about 25–35% of an overall length of the flex handle tool.

14. The flex handle tool of claim 10 wherein said at least two wings are aligned in a plane substantially perpendicular to the axis of the pivot.

15. The flex handle tool of claim 10 wherein said toothed hub has a plurality of hub teeth extending radially from said pivot spanning an arc of more than one hundred eighty degrees.

16. The flex handle tool of claim 10 wherein said locking mechanism further comprises at least two teeth, said at least two teeth engage at least two surfaces of the toothed hub in said first position.

17. The flex handle tool of claim 16 whereby said locking mechanism may be positioned to said second position in which said locking mechanism is linearly displaced in a direction radially away from said toothed hub.

18. The flex handle tool of claim 10 wherein said yoke further comprises a pair of clevis arms located on a top and a bottom portion of said toothed hub and having an opposing pair of arm apertures located at said pivot, said toothed hub having a hub aperture located at said pivot, and said hub aperture and said arm apertures receiving a pin.

19. A flex handle adjustable wrench comprising:

a handle portion having a yoke at a forward end;

a tool head for rotational operation in a plane coupled to said yoke at a pivot for movement of the handle portion orthogonal to the operational plane, said tool head having first and second planar outer surface portions and at least a portion of a toothed hub facing rearwardly of said pivot into said yoke and an adjustable wrench device facing substantially forward of said pivot, said wrench device having a first and a second planar outer surface area, said first and said second outer surface areas coinciding with a first and a second plane, said first and second planes intersecting at a plane intersection angle, said toothed hub located between said first and second plane and within the plane intersection angle; and a locking mechanism.

* * * * *